US010793394B2

(12) United States Patent
Ginsberg et al.

(10) Patent No.: US 10,793,394 B2
(45) Date of Patent: Oct. 6, 2020

(54) WIRELESS COMMUNICATION FOR SELF-PROPELLED ELEVATOR SYSTEM

(71) Applicant: Otis Elevator Company, Farmington, CT (US)

(72) Inventors: David Ginsberg, Granby, CT (US); Dang V. Nguyen, South Windsor, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 498 days.

(21) Appl. No.: 15/547,920

(22) PCT Filed: Feb. 2, 2016

(86) PCT No.: PCT/US2016/016137

§ 371 (c)(1),
(2) Date: Aug. 1, 2017

(87) PCT Pub. No.: WO2016/126686

PCT Pub. Date: Aug. 11, 2016

(65) Prior Publication Data

US 2018/0022575 A1 Jan. 25, 2018

Related U.S. Application Data

(60) Provisional application No. 62/112,261, filed on Feb. 5, 2015.

(51) Int. Cl.
*B66B 1/30* (2006.01)
*B66B 1/34* (2006.01)
(Continued)

(52) U.S. Cl.
CPC ..... *B66B 1/30* (2013.01); *B66B 1/3446* (2013.01); *B66B 1/3461* (2013.01);
(Continued)

(58) Field of Classification Search
CPC ..... B66B 1/30; B66B 1/3446; B66B 1/3461; B66B 1/3492
(Continued)

(56) References Cited

U.S. PATENT DOCUMENTS 5,654,531 A * 8/1997 Farabee ..... B66B 1/18 187/247
5,682,024 A * 10/1997 Koopman, Jr. ..... B66B 1/50 187/283
(Continued)

FOREIGN PATENT DOCUMENTS

CN 1462718 A 12/2003
CN 101219744 A 7/2008
WO 2014113006 A1 7/2014

OTHER PUBLICATIONS

International Search Report and Written Opinion for application PCT/US2016/016137, dated May 30, 2016, 12pgs.
(Continued)

*Primary Examiner* — David S Warren
(74) *Attorney, Agent, or Firm* — Cantor Colburn LLP

(57) ABSTRACT

A self-propelled elevator system includes a hoistway (11) including a plurality of drives (40), wherein each of the plurality of drives includes a stationary portion (16) of a propulsion system and a controller (30) configured to operate the stationary portion of the propulsion system. The propelled elevator system also includes an elevator car ((14), 42) comprising a processor (44) and a transceiver (48), wherein the transceiver is configured to communicate with the controllers of one or more of the plurality of drives that are adjacent to the elevator car and one or more sensors (46) disposed on the elevator car, wherein the processor is configured to receive signals from the one or more sensors.
(Continued)

The processor is configured to control a movement of the elevator car within the hoistway.

18 Claims, 7 Drawing Sheets

(51) Int. Cl.
*B66B 5/00* (2006.01)
*B66B 9/00* (2006.01)
*B66B 11/04* (2006.01)

(52) U.S. Cl.
CPC ..... *B66B 1/3492* (2013.01); *B66B 5/0018* (2013.01); *B66B 9/00* (2013.01); *B66B 9/003* (2013.01); *B66B 11/0407* (2013.01)

(58) Field of Classification Search
USPC ..... 187/247
See application file for complete search history.

(56) References Cited

U.S. PATENT DOCUMENTS 6,253,879 B1* 7/2001 Skalski ..... B66B 5/06 187/287
2012/0185331 A1* 7/2012 Gazdzinski ..... G06Q 30/0251 705/14.49
2012/0192289 A1* 7/2012 Gazdzinski ..... G06Q 30/0251 726/28
2012/0197647 A1* 8/2012 Gazdzinski ..... G06Q 30/0251 704/275
2012/0206362 A1* 8/2012 Gazdzinski ..... G06Q 30/0251 345/168
2012/0221412 A1* 8/2012 Gazdzinski ..... G06Q 30/0251 705/14.57
2013/0048436 A1* 2/2013 Chan ..... B66B 1/2408 187/387
2013/0185640 A1* 7/2013 Gazdzinski ..... G06Q 30/0251 715/728
2013/0191023 A1* 7/2013 Gazdzinski ..... G06Q 30/0251 701/533
2013/0205214 A1* 8/2013 Gazdzinski ..... G06Q 30/0251 715/728
2015/0019226 A1* 1/2015 Gazdzinski ..... G06Q 30/0251 704/254
2015/0032455 A1* 1/2015 Gazdzinski ..... G06Q 30/0251 704/270
2015/0032459 A1* 1/2015 Gazdzinski ..... G06Q 30/0251 704/275
2015/0039136 A1* 2/2015 Gazdzinski ..... G06Q 30/0251 700/276
2015/0046820 A1* 2/2015 Gazdzinski ..... G06Q 30/0251 715/719
2015/0058000 A1* 2/2015 Gazdzinski ..... G06Q 30/0251 704/231
2015/0081309 A1* 3/2015 Gazdzinski ..... G06Q 30/0251 704/275
2016/0214832 A1* 7/2016 Banno ..... B66B 5/06
2017/0032785 A1* 2/2017 Gazdzinski ..... G06Q 30/0251
2017/0102918 A1* 4/2017 Gazdzinski ..... G06Q 30/0251
2017/0115643 A1* 4/2017 Gazdzinski ..... G06Q 30/0251
2017/0355554 A1* 12/2017 Eleid ..... G06F 3/0484
2017/0362062 A1* 12/2017 Ginsberg ..... B66B 9/02
2018/0022573 A1* 1/2018 Hsu ..... B66B 5/0087 187/247
2018/0022574 A1* 1/2018 Pasini ..... B66B 11/0407 187/247
2018/0022575 A1* 1/2018 Ginsberg ..... B66B 1/3446 187/247
2018/0334356 A1* 11/2018 Krishnamurthy ..... B66B 1/34
2018/0362290 A1* 12/2018 Fargo ..... B66B 11/0407

OTHER PUBLICATIONS

Chinese First Office Action for application 201680008908.4, dated Jan. 31, 2019, 10 pages.

* cited by examiner

WIRELESS COMMUNICATION FOR SELF-PROPELLED ELEVATOR SYSTEM

TECHNICAL FIELD

The subject matter disclosed herein relates generally to the field of elevators, and more particularly to a wireless communication system for a self-propelled elevator system.

BACKGROUND

Communications in elevator systems require very high reliability and very low latency. Accordingly, such communications are conventionally performed using dedicated wired medium. Currently, in order to send safety messages between a controller and an elevator car, a communication cable is suspended in the shaft, and moves along with the car. As building height increases, the weight and cost of the communication cable increases significantly. As the weight increases, power consumption for the elevator system also increases.

Ropeless elevator systems, also referred to as self-propelled elevator systems, are useful in certain applications (e.g., high rise buildings) where the mass of the ropes for a roped system is prohibitive and there is a desire for multiple elevator cars to travel in a single lane. There exist ropeless elevator systems in which a first lane is designated for upward traveling elevator cars and a second lane is designated for downward traveling elevator cars. A transfer station at each end of the hoistway is used to move cars horizontally between the first lane and second lane.

Accordingly, an improved system for communications for use in self-propelled elevator systems is desired.

BRIEF SUMMARY

According to an exemplary embodiment a self-propelled elevator system includes a hoistway including a plurality of drives, wherein each of the plurality of drives includes a stationary portion of a propulsion system and a controller configured to operate the stationary portion of the propulsion system. The propelled elevator system also includes an elevator car comprising a processor and a transceiver, wherein the transceiver is configured to communicate with the controllers of one or more of the plurality of drives that are adjacent to the elevator car and one or more sensors disposed on the elevator car, wherein the processor is configured to receive signals from the one or more sensors. The processor is configured to control a movement of the elevator car within the hoistway.

According to another exemplary embodiment a self-propelled elevator system includes a hoistway including a plurality of drives, wherein each of the plurality of drives includes a stationary portion of a propulsion system and a controller configured to operate the stationary portion of the propulsion system and a plurality of wireless communication bridges, each of the plurality of wireless communication bridges being configured to communicate with a subset of the plurality of drives in a vicinity of the wireless communication bridge. The self-propelled elevator system also includes an elevator car comprising a processor and a transceiver, wherein the transceiver is configured to communicate with one or more of the plurality of wireless communication bridge adjacent to the elevator car and one or more sensors disposed on the elevator car, wherein the processor is configured to receive signals from the one or more sensors. The processor is configured to control a movement of the elevator car within the hoistway.

According to a further exemplary embodiment a self-propelled elevator system includes a hoistway including a plurality of drives, wherein each of the plurality of drives includes a stationary portion of a propulsion system and a controller configured to operate the stationary portion of the propulsion system and an elevator car comprising a processor and a transceiver, wherein the transceiver is configured to communicate with the controllers of one or more of the plurality of drives that are adjacent to the elevator car. The self-propelled elevator system also includes one or more sensors disposed on the elevator car, wherein the processor is configured to receive signals from the one or more sensors. The controllers of one or more of the plurality of drives that are adjacent to the elevator car are configured to control a movement of the elevator car within the hoistway.

Other aspects, features, and techniques of embodiments will become more apparent from the following description taken in conjunction with the drawings.

BRIEF DESCRIPTION OF THE DRAWINGS

Referring now to the drawings wherein like elements are numbered alike in the FIGURES.

DETAILED DESCRIPTION

Exemplary embodiments include wireless communication system for a self-propelled elevator system. It will be understood by those of ordinary skill in the art that the wireless communication system disclosed can be used in conjunction with any suitable self-propelled elevator system and that the self-propelled elevator systems shown in FIGS. 1 and 2 are merely exemplary in nature.

Figure 1:
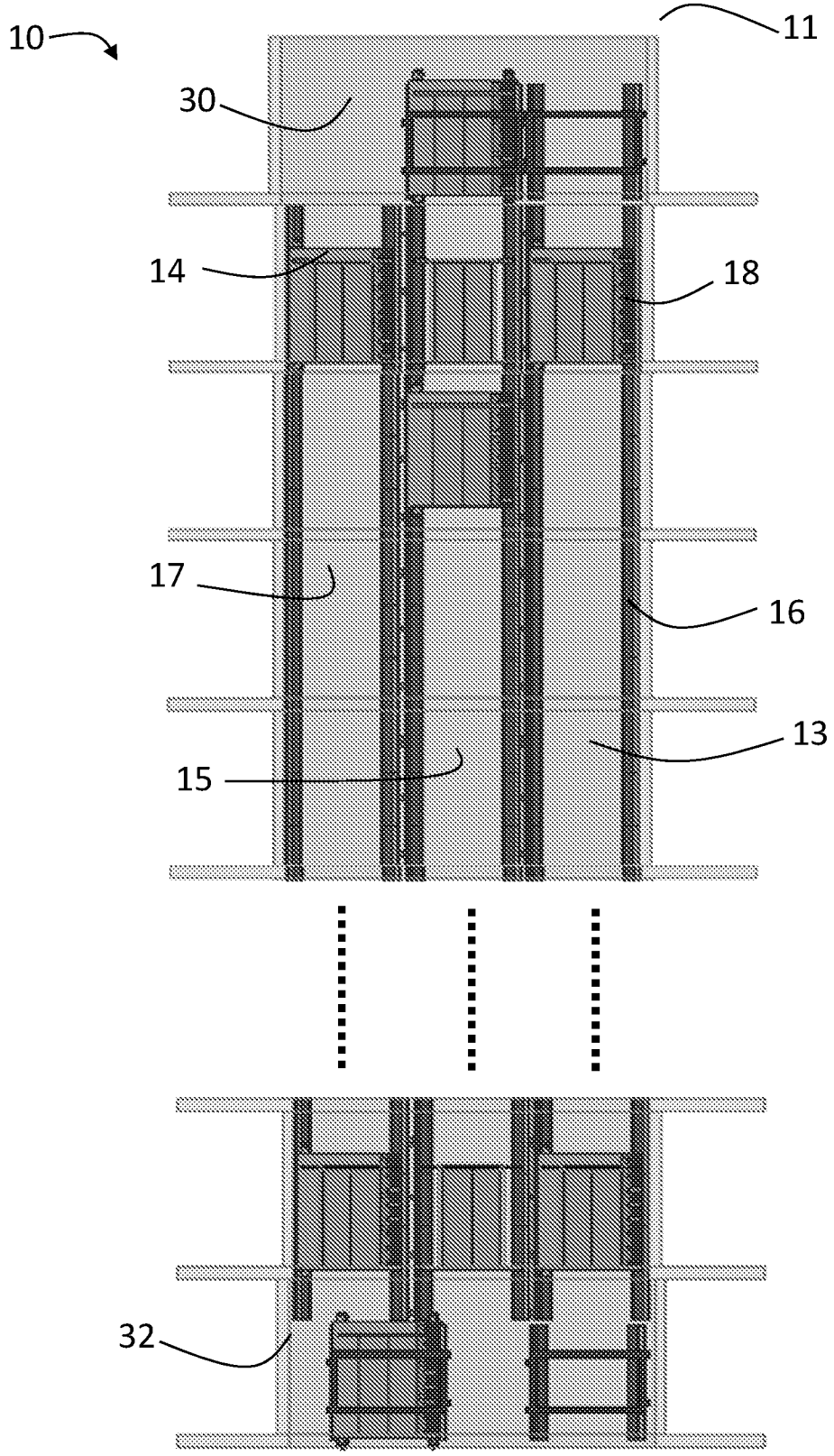
FIG. 1 depicts an multicar ropeless elevator system in accordance with an exemplary embodiment.
Figure 2:
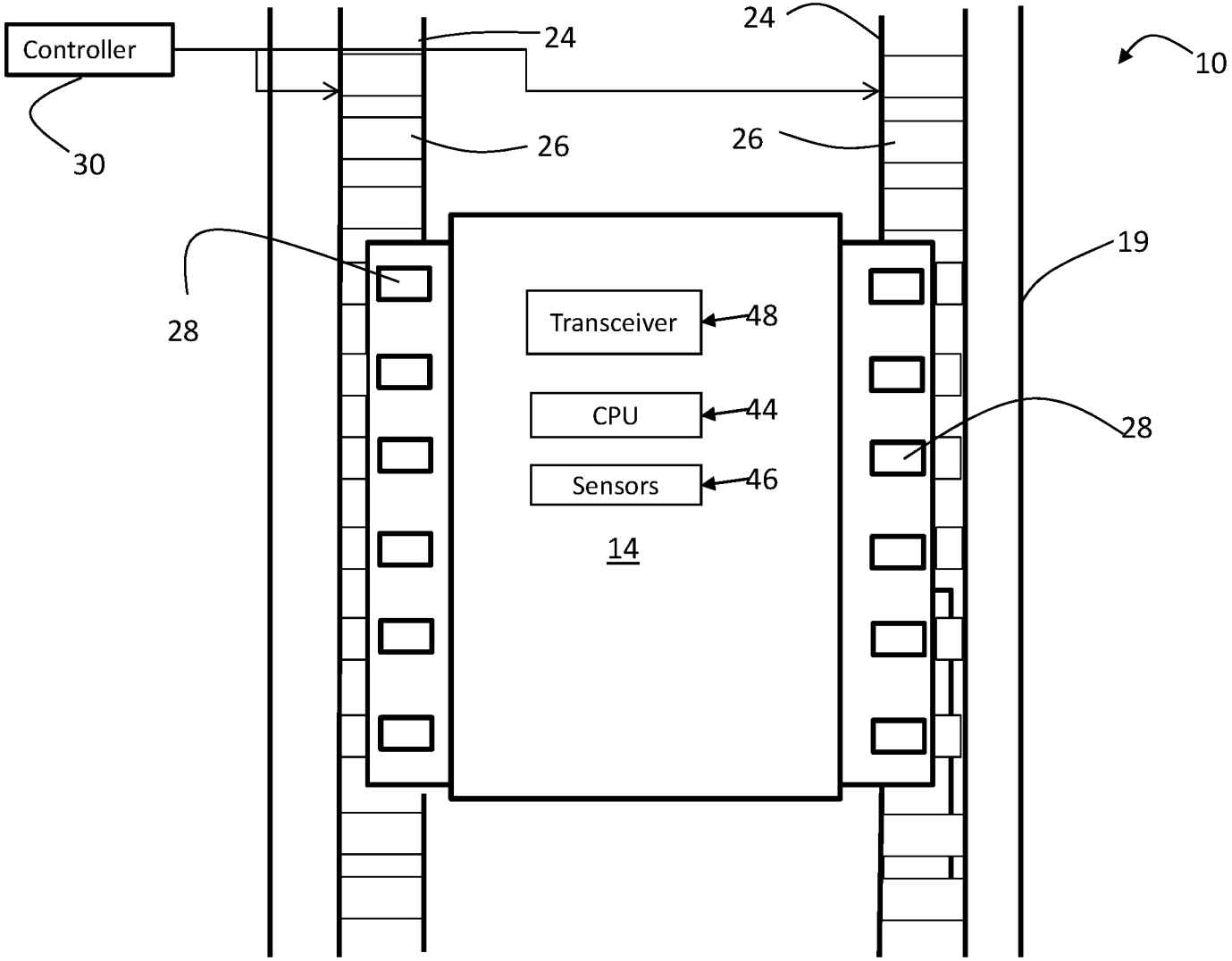
FIG. 2 depicts a portion of the elevator system in accordance with an exemplary embodiment.

FIG. 1 depicts an multicar, ropeless elevator system 10 in an exemplary embodiment. Elevator system 10 includes a hoistway 11 having a plurality of lanes 13, 15 and 17. While three lanes are shown in FIG. 1, it is understood that embodiments may be used with multicar, ropeless elevator systems have any number of lanes. In each lane 13, 15, 17, cars 14 travel may travel in one or both directions, i.e., up and/or down. For example, in FIG. 1 cars 14 in lanes 13 and 15 travel up and cars 14 in lane 17 travel down. One or more cars 14 may travel in a single lane 13, 15, and 17. In some operational modes cars 14 may move in any direction which does not conflict with a neighboring car, this operational mode is referred to as "2D" operation.

Above the top floor is an upper transfer station 30 to impart horizontal motion to elevator cars 14 to move elevator cars 14 between lanes 13, 15 and 17. It is understood that upper transfer station 30 may be located at the top floor, rather than above the top floor. Below the first floor is a lower transfer station 32 to impart horizontal motion to elevator cars 14 to move elevator cars 14 between lanes 13, 15 and 17. It is understood that lower transfer station 32 may be located at the first floor, rather than below the first floor. Although not shown in FIG. 1, one or more intermediate transfer stations may be used between the first floor and the top floor. Intermediate transfer stations are similar to the upper transfer station 30 and lower transfer station 32.

Cars 14 are propelled using a linear motor system having a primary, fixed portion 16 and a secondary, moving portion 18. The primary portion 16 includes windings or coils mounted at one or both sides of the lanes 13, 15 and 17. Secondary portion 18 includes permanent magnets mounted to one or both sides of cars 14. Primary portion 16 is supplied with drive signals to control movement of cars 14 in their respective lanes.

FIG. 2 depicts an elevator system 10 having a self-propelled elevator car 14 in an exemplary embodiment. Elevator system 10 includes an elevator car 14 that travels in a hoistway 11. Elevator car 14 is guided by one or more guide rails 24 extending along the length of hoistway 11, the guide rails may be affixed to the structural member 19. Elevator system 10 employs a linear motor having a stator 26 including a plurality of phase windings. Stator 26 may be mounted to guide rail 24, incorporated into the guide rail 24, or may be located apart from guide rail 24. Stator 26 serves as one portion of a permanent magnet synchronous linear motor to impart motion to elevator car 14. Permanent magnets 28 are mounted to car 14 to provide a second portion of the permanent magnet synchronous linear motor. Windings of stator 26 may be arranged in three phases, six phases, or multiples thereof, as is known in the electric motor art, as is known in the electric motor art. Two stators 26 may be positioned in the hoistway 11, to coact with permanent magnets 28 mounted to elevator car 14. The permanent magnets 28 may be positioned on two sides of elevator car 14, as shown in FIG. 2. Alternate embodiments may use a single stator 26—permanent magnet 28 configuration, or multiple stator 26—permanent magnet 28 configurations.

A controller 30 provides drive signals to the stator(s) 26 to control motion of the elevator car 14. Controller 30 may be implemented using a general-purpose microprocessor executing a computer program stored on a storage medium to perform the operations described herein. Alternatively, controller 30 may be implemented in hardware (e.g., ASIC, FPGA) or in a combination of hardware/software. Controller 30 may also be part of an elevator control system. Controller 30 may include power circuitry (e.g., an inverter or drive) to power the stator(s) 26. Although a single controller 30 is depicted, it will be understood by those of ordinary skill in the art that a plurality of controllers 30 may be used. For example, a single controller 30 may be provided to control the operation of a group of stators 26 over a relatively short distance.

In exemplary embodiments, the elevator car 14 includes one or more transceivers 48, one or more sensors 46 and a processor, or CPU, 44. The sensors 46 can be used to monitor a wide variety of conditions of the elevator car 14 including, but not limited to, the speed of the elevator car 14, an acceleration of the elevator car 14, a load in the elevator car 14, a position of the doors of the elevator car 14, and a position of the breaks of the elevator car 14. In exemplary embodiments, the processor 44 is configured to monitor the one or more sensors and to communicate with one or more controllers 30 via the transceivers 48. In exemplary embodiments, to ensure reliable communication, each elevator car 14 may include at least two transceivers 48. The transceivers 48 can be set to operate at different frequencies, or communications channels, to minimize interference and to provide full duplex communication between the elevator car 14 and the one or more controllers 30.

Figure 3:
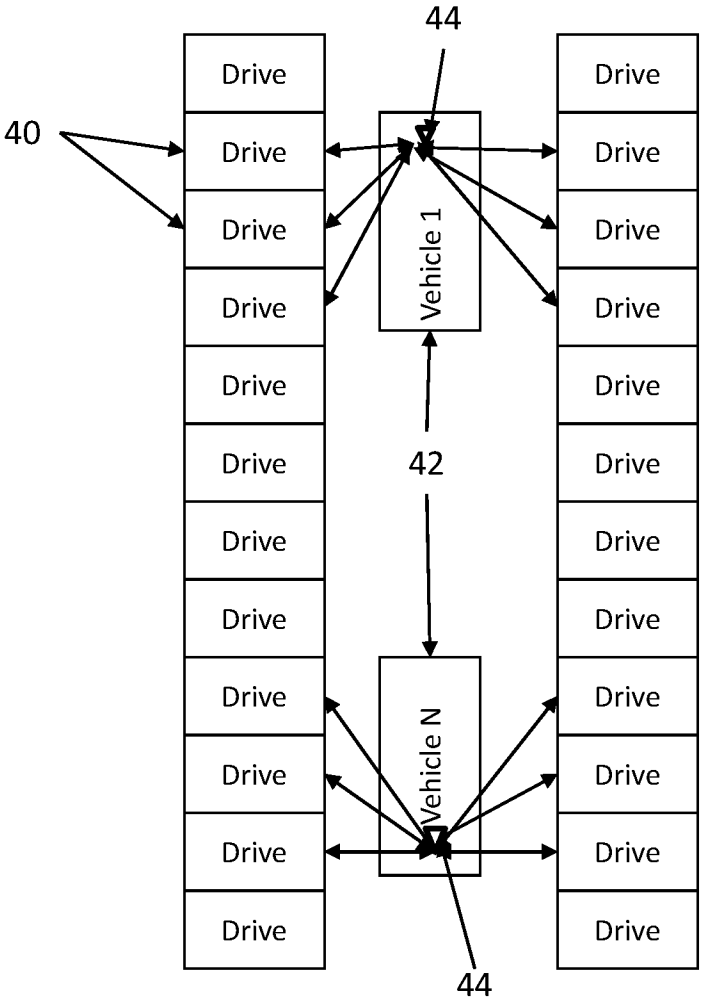
FIG. 3 is block diagram of an elevator system having a wireless communication in accordance with an exemplary embodiment.

Referring now to FIG. 3, an elevator system having a wireless communication in accordance with an exemplary embodiment is shown. As illustrated, the elevator system includes one or more elevator cars 42 which are disposed in a hoistway adjacent to a plurality of drives 40. Each of the drives includes a controller configured to operate a plurality of stators to impart motion to elevator car 42 and each of the elevator cars 42 includes a transceiver 48 that is configured to communicate with the drives 40. In exemplary embodiments, the elevator cars 42 may be configured to instruct the drives 40 to move the elevator car 42 up and down in the hoistway.

Figure 4:
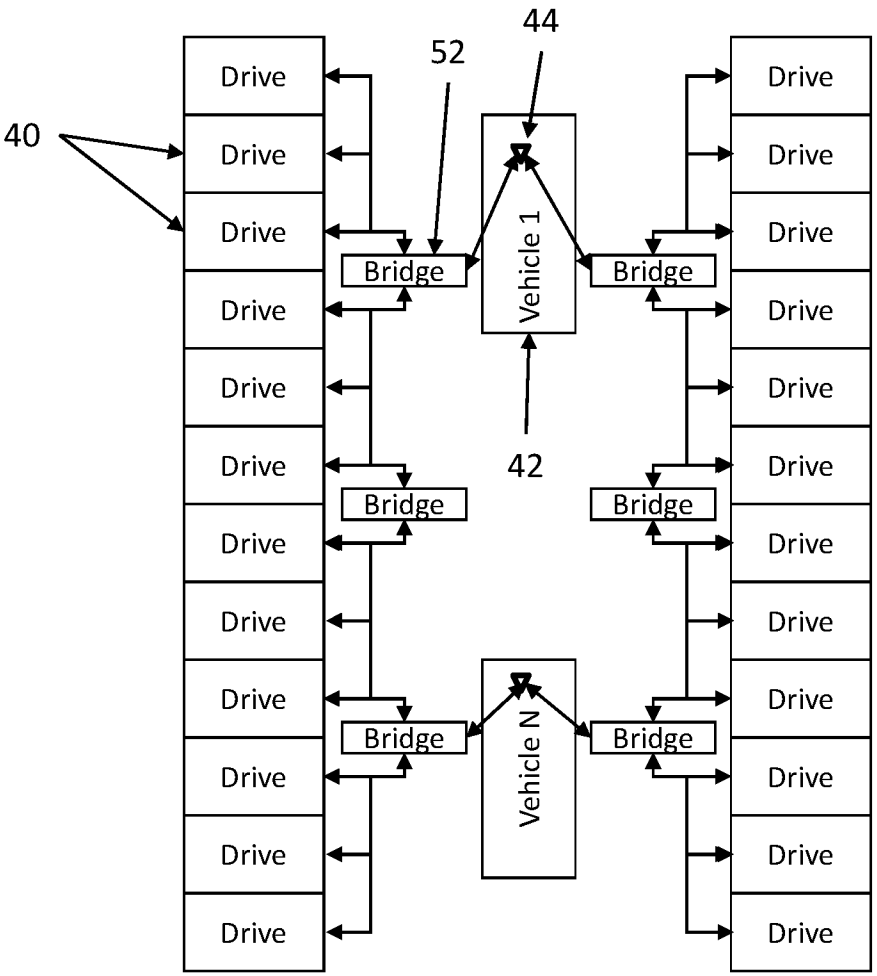
FIG. 4 is block diagram of an elevator system having a wireless communication in accordance with an exemplary embodiment.

Referring now to FIG. 4, an elevator system having a wireless communication in accordance with another exemplary embodiment is shown. As illustrated, the elevator system includes one or more elevator cars 42 which are disposed in a hoistway adjacent to a plurality of drives 40. Each of the drives includes a controller configured to operate a plurality of stators to impart motion to elevator car 42. The elevator system also includes a plurality of wireless communication bridges 52, also referred to as bridges 52, which are configured to communicate with each of the elevator cars 42 via the transceivers 48. The wireless communication bridges 52 are also configured to communicate with a group of drives 40 in proximity of the bridges 52. In exemplary embodiments, the elevator cars 42 may be configured to instruct the drives 40, via the bridges 52, to move the elevator car 42 up and down in the hoistway.

Figure 5:
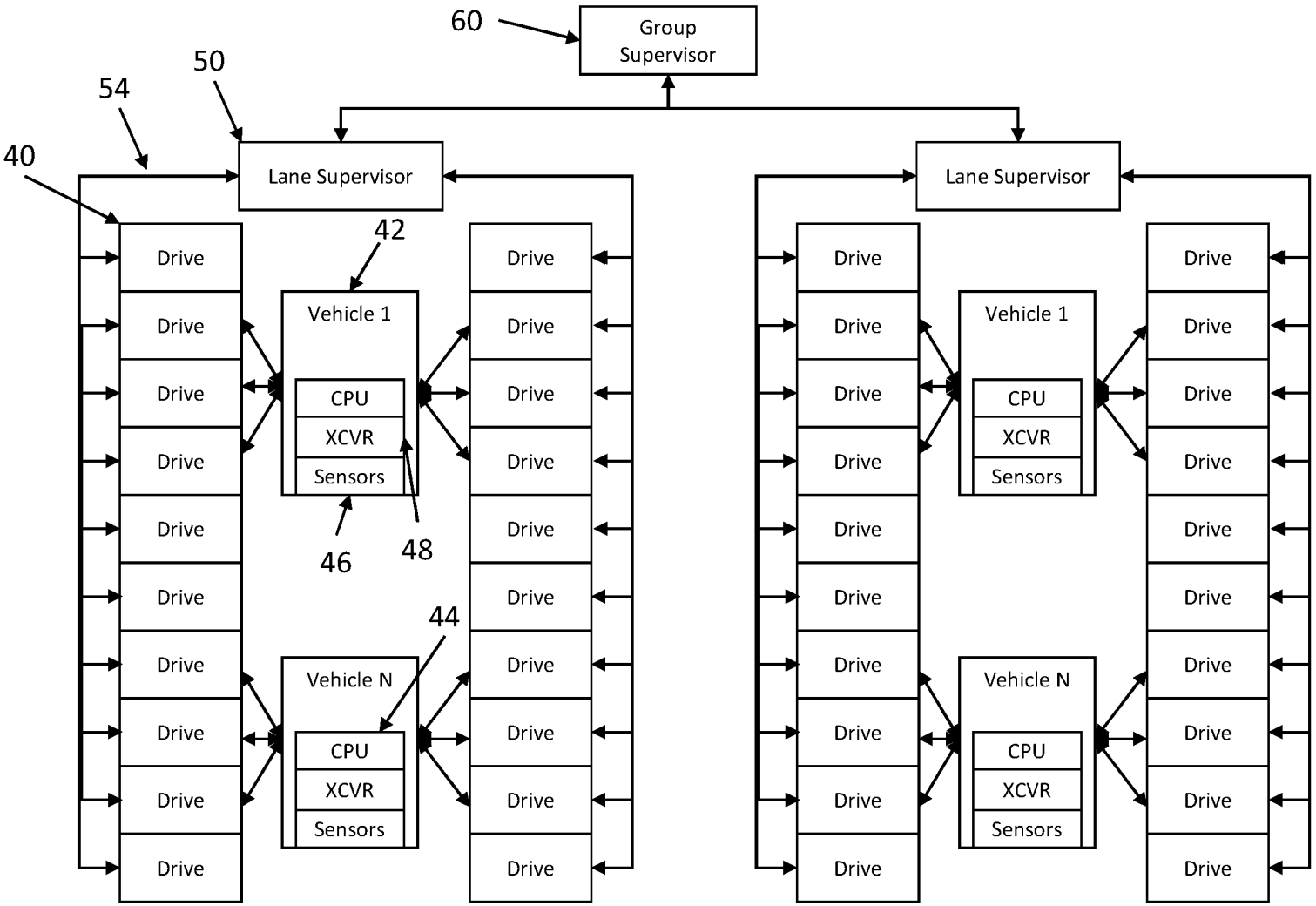
FIG. 5 is block diagram of an elevator system having a wireless communication in accordance with another exemplary embodiment.

Referring now to FIG. 5, an elevator system having a wireless communication in accordance with a further exemplary embodiment is shown. As illustrated, the elevator system includes one or more elevator cars 42 which are disposed in one of multiple hoistways. Each hoistway includes a plurality of drives 40 that are disposed adjacent to the one or more elevator cars 42. Each of the drives 40 includes a controller configured to operate a plurality of stators to impart motion to elevator car 42 and each of the elevator cars 42 includes a transceiver 48 that is configured to communicate with the drives 40. In this embodiment, the processor 44 of the elevator car 42 controls the motion of the elevator cars 42 within the hoistway. In other words, the elevator cars 42 may be configured to instruct the drives 40 to move the elevator car 42 up and down in the hoistway.

In exemplary embodiments, each of the drives 40 is configured to communicate with a lane supervisor 50 via a wired communications system 52. The lane supervisor 50 is configured to monitor the position of each of the elevator cars 42 in the hoistway. The lane supervisor 50 may also be configured to provide instructions to the elevator cars 42 in the hoistway to move up and down in the hoistway. For example, the lane supervisor 50 may issue a Set Target Vertical command to the elevator car 42, which instructs the elevator car 42 to move to a set position in the hoistway. In exemplary embodiments, the lane supervisor 50 may communicate with a group supervisor 60 to orchestrate the movement of the one or more elevators cars 42 in each of the hoistways in a group. For example, upon receiving a call for an elevator at a floor in the building, the group supervisor may assign the call to one of the lane supervisors 50.

In exemplary embodiments, the control of the movement of the elevator car 42 performed by the processor 44 disposed on the elevator car 42. The processor 44 receives commands via a user interface within the elevator car and from the lane supervisor 50 and responsively controls the movement of the elevator car 42. The processor 44 is configured to control the operation of the doors and brakes disposed on the elevator car 42. Furthermore, the processor 44 is configured to receive signals from the one or more sensors to ensure proper and safe operation of the elevator car 42. For example, the processor 44 is configured to ensure that the doors are in a closed position prior to disengaging the break and initiating movement of the elevator car 42.

In exemplary embodiments, the processor 44 is configured to utilize the one or more transceivers 48 to communicate with only the drives 40 in the immediate vicinity of the elevator car 42. Since the distance between the drives 40 and the transceivers 48 on the elevator car 42 is small, the wireless communication between the two is very reliable. For example, the transceivers 48 may be configured with an effective range that is less than a height of the elevator car 42. Short range wireless communications are characterized by both high bandwidth and low latency, which are ideal for controlling the operation of the elevator system.

Figure 6:
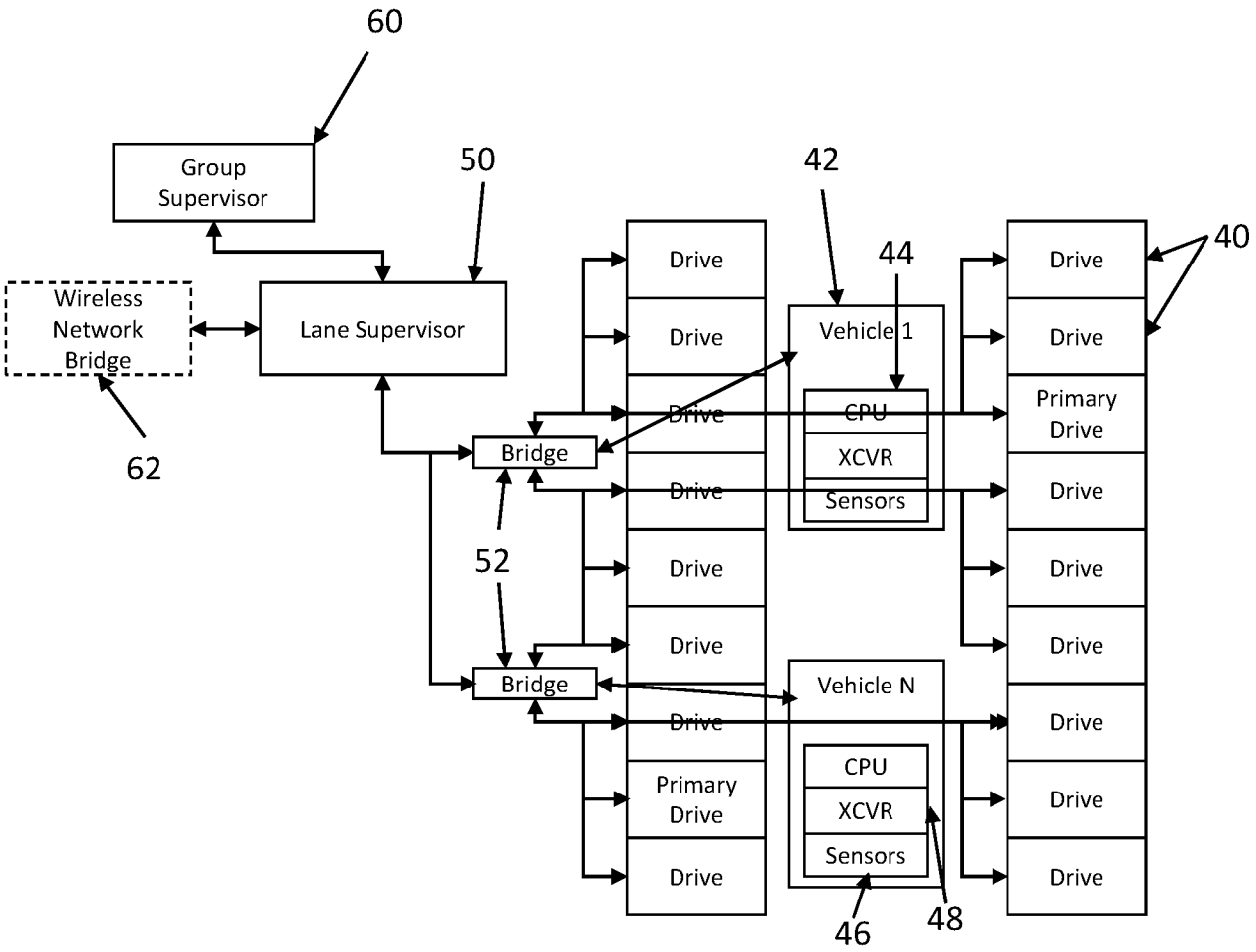
FIG. 6 is block diagram of an elevator system having a wireless communication in accordance with a further exemplary embodiment.

Referring now to FIG. 6, an elevator system having a wireless communication in accordance with a further exemplary embodiment is shown. As illustrated, the elevator system includes one or more elevator cars 42 which are disposed in one of multiple hoistways. Each hoistway includes a plurality of drives 40 that are disposed adjacent to the one or more elevator cars 42. Each of the drives 40 includes a controller configured to operate a plurality of stators to impart motion to elevator car 42 and each of the elevator cars 42 includes a transceiver 48 that is configured to communicate with a wireless communication bridge 52. In turn, the wireless communication bridge 52 is configured to communicate with a group of drives 40. In this embodiment, the controller disposed in one of the drives 40 in the group of drives, referred to herein as the primary drive, is used to control the motion of the elevator cars 42 within the hoistway. As the elevator car 42 moves up and down in the hoistway the designation of the drive that is the primary drive will change such that the primary drive is always immediately adjacent to the elevator car 42.

In exemplary embodiments, each of the drives 40 is configured to communicate with a lane supervisor 50 via a wired communications system 52. The lane supervisor 50 is configured to monitor the position of each of the elevator cars 42 in the hoistway. The lane supervisor 50 may also be configured to provide instructions to the primary drives 40 in the hoistway to move the elevator car 42 up and down in the hoistway. For example, the lane supervisor 50 may issue a Set Target Vertical command to the elevator car 42, which instructs the drives 40 to move the elevator car 42 to a set position in the hoistway. In exemplary embodiments, the wireless communication bridge 52 is configured to communicate with the lane supervisor 50 via a wireless network bridge 62. In exemplary embodiments, the lane supervisor 50 may communicate with a group supervisor 60 to orchestrate the movement of the one or more elevators cars 42 in each of the hoistways in a group. For example, upon receiving a call for an elevator at a floor in the building, the group supervisor may assign the call to one of the lane supervisors 50.

In exemplary embodiments, the control of the movement of the elevator car 42 performed by the controller disposed on the primary drive 40. The controller is configured to communicate with the processor 44 of the elevator car 42 via the transceiver 48. The processor 44 receives commands via a user interface within the elevator car and transmits them to the controller. The controller also receives commands from the lane supervisor 50 and responsively controls the movement of the elevator car 42. The controller is configured to ensure proper and safe operation of the elevator car 42. For example, the controller is configured to ensure that the doors are in a closed position prior to disengaging the break and initiating movement of the elevator car 42.

In exemplary embodiments, the elevator car 42 is configured to utilize the one or more transceivers 48 to communicate with only the wireless communications bridge 52 in the immediate vicinity of the elevator car 42. Since the distance between the wireless communications bridge 52 and the transceivers 48 on the elevator car 42 is small, the wireless communication between the two is very reliable. For example, the transceivers 48 may be configured with an effective range that is less than a height of the elevator car 42. Short range wireless communications are characterized by both high bandwidth and low latency, which are ideal for controlling the operation of the elevator system.

Figure 7:
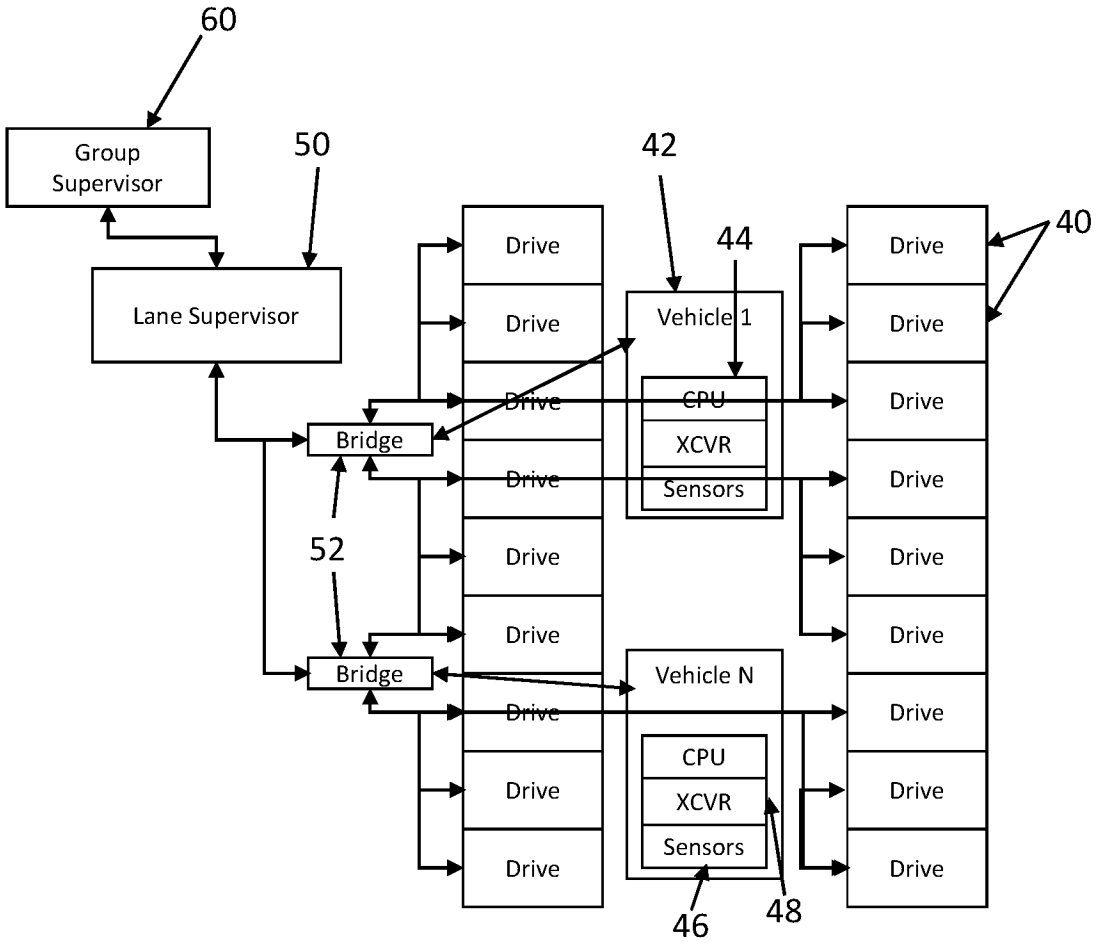
FIG. 7 is block diagram of an elevator system having a wireless communication in accordance with yet another exemplary embodiment.

Referring now to FIG. 7, an elevator system having a wireless communication in accordance with a further exemplary embodiment is shown. As illustrated, the elevator system includes one or more elevator cars 42 which are disposed in one of multiple hoistways. Each hoistway includes a plurality of drives 40 that are disposed adjacent to the one or more elevator cars 42. Each of the drives 40 includes a controller configured to operate a plurality of stators to impart motion to elevator car 42 and each of the elevator cars 42 includes a transceiver 48 that is configured to communicate with a wireless communication bridge 52. In turn, the wireless communication bridge 52 is configured to communicate with a group of drives 40. In this embodiment, the processor 44 of the elevator car 42 controls the motion of the elevator cars 42 within the hoistway. In other words, the elevator cars 42 may be configured to instruct the drives 40, via the wireless communication bridge 52, to move the elevator car 42 up and down in the hoistway.

In exemplary embodiments, each of the drives 40 is configured to communicate with a lane supervisor 50 via a wired communications system 54. The lane supervisor 50 is configured to monitor the position of each of the elevator cars 42 in the hoistway. The lane supervisor 50 may also be configured to provide instructions to the elevator cars 42 in the hoistway to move up and down in the hoistway. For example, the lane supervisor 50 may issue a Set Target Vertical command to the elevator car 42, which instructs the elevator car 42 to move to a set position in the hoistway. In exemplary embodiments, the lane supervisor 50 may communicate with a group supervisor 60 to orchestrate the movement of the one or more elevators cars 42 in each of the hoistways in a group. For example, upon receiving a call for an elevator at a floor in the building, the group supervisor may assign the call to one of the lane supervisors 50.

In exemplary embodiments, the drives 40 are configured to communicate with one another via the wired communications system 54. For example, the controllers of adjacent drives may communicate with the wired communications system 54 to coordinate the operation of the stators to ensure smooth movement of the elevator car 42. In exemplary embodiments, the elevator car 42 may be configured to communicate with multiple adjacent drives 40 and the drives 40 may communicate with one another via the wired communications system 54 to provide messaging redundancy to further improve the reliability of the wireless communication system.

In exemplary embodiments, the control of the movement of the elevator car 42 performed by the processor 44 disposed on the elevator car 42. The processor 44 receives commands via a user interface within the elevator car and from the lane supervisor 50 and responsively controls the movement of the elevator car 42. The processor 44 is configured to control the operation of the doors and breaks disposed on the elevator car 42. Furthermore, the processor 44 is configured to receive signals from the one or more sensors to ensure proper and safe operation of the elevator car 42. For example, the processor 44 is configured to ensure that the doors are in a closed position prior to disengaging the break and initiating movement of the elevator car 42.

In exemplary embodiments, the processor 44 is configured to utilize the one or more transceivers 48 to communicate with a wireless communication bridge 52 coupled to the drives 40 in the immediate vicinity of the elevator car 42. Since the distance between the wireless communication bridge 52 and the transceivers 48 on the elevator car 42 is small, the wireless communication between the two is very reliable. For example, the transceivers 48 may be configured with an effective range that is less than a height of the elevator car 42. Short range wireless communications are characterized by both high bandwidth and low latency, which are ideal for controlling the operation of the elevator system.

In exemplary embodiments, the elevator cars 42 may include a plurality of transceivers 48 that can be configured to utilize different frequencies or communication channels for receiving and transmitting to accomplish full duplex operation. In addition, the frequency, mm wavelength for directionality, and transmission power of the wireless communications can be selected to control the effective range of the wireless communication. In exemplary embodiments, the wireless communication system may include messaging redundancy that includes sending the same messages to multiple drives using wireless and wired communications systems. In addition, the wireless communication system includes redundancy at the vehicle messaging level to avoid any vehicle confusion.

Embodiments increase capacity (passenger per hour) of vertical transportation in tall and mega tall buildings as well as decrease floor area occupied by the elevator system. Embodiments improve performance by increasing traffic density (e.g., more than doubling the number of passengers per minute delivered to the top floor comparing to double deck rope shuttle elevator system). Embodiments reduce surface area on each floor occupied by the vertical transportation system in the building which leads to increased utilization of building space for customer. Embodiments provide easier and reduced cost of maintenance. There is no periodic replacement of the ropes. Maintenance and inspection of an individual car does not require shutting down whole elevator system. Embodiments provide modularity with a one-time development investment. A system designed and developed one time can be (and should be) applicable to different buildings with a wide range of rise (e.g., a taller building will require a larger number of the same modules than a shorter building). Embodiments eliminate the use of heavy installation equipment as there will be no need for a costly lifting crane mounted in the building core to lift heavy machine(s). Embodiments also eliminate the need for ropes installation as well as the use of heavy, double-deck car construction with safeties. Embodiments provide system flexibility and adaptability to the actual needs of traffic. Car profiles, destinations, commissioning, decommissioning, periodic breaks for maintenance and inspection are controlled independently and with coordination of the functioning of whole system.

The terminology used herein is for the purpose of describing particular embodiments only and is not intended to be limiting. While the description of the present disclosure has been presented for purposes of illustration and description, it is not intended to be exhaustive or limited to the disclosure in the form disclosed. Many modifications, variations, alterations, substitutions, or equivalent arrangement not hereto described will be apparent to those of ordinary skill in the art without departing from the scope of the disclosure. Additionally, while the various embodiments of the disclosure have been described, it is to be understood that aspects of the disclosure may include only some of the described embodiments. Accordingly, the disclosure is not to be seen as being limited by the foregoing description, but is only limited by the scope of the appended claims.

The invention claimed is:

1. A self-propelled elevator system comprising:

a hoistway including a plurality of drives, wherein each of the plurality of drives includes a stationary portion of a propulsion system and a controller configured to operate the stationary portion of the propulsion system;

an elevator car comprising a processor and a transceiver, wherein the transceiver is configured to communicate with the controllers of one or more of the plurality of drives that are adjacent to the elevator car; and one or more sensors disposed on the elevator car, wherein the processor is configured to receive signals from the one or more sensors, wherein the processor is configured to control a movement of the elevator car within the hoistway.

2. The self-propelled elevator system of claim 1, wherein the one or more sensors are configured to monitor at least one of:

a speed of the elevator car;

an acceleration of the elevator car;

a load in the elevator car;

a position of one or more doors of the elevator car; and a position of one or more brakes of the elevator car.

3. The self-propelled elevator system of claim 1, wherein the elevator car further comprises a second transceiver, wherein the second transceiver is configured to operate on a different frequency than the transceiver to provide full duplex communication.

4. The self-propelled elevator system of claim 1, wherein the controller of each of the plurality of drives are configured to communicate with each other via a wired communications system.

5. The self-propelled elevator system of claim 4, further comprising a lane supervisor configured to communicate with the plurality of drives via the wired communications system, wherein the lane supervisor is configured to monitor the position of the elevator car in the hoistway and to provide instructions to the elevator car to move up and down in the hoistway.

6. The self-propelled elevator system of claim 1, wherein an effective range of the transceiver is less than a height of the elevator car.

7. A self-propelled elevator system comprising:

a hoistway including a plurality of drives, wherein each of the plurality of drives includes a stationary portion of a propulsion system and a controller configured to operate the stationary portion of the propulsion system;

a plurality of wireless communication bridges, each of the plurality of wireless communication bridges being configured to communicate with a subset of the plurality of drives in a vicinity of the wireless communication bridge;

an elevator car comprising a processor and a transceiver, wherein the transceiver is configured to communicate with one or more of the plurality of wireless communication bridge adjacent to the elevator car; and one or more sensors disposed on the elevator car, wherein the processor is configured to receive signals from the one or more sensors, wherein the processor is configured to control a movement of the elevator car within the hoistway.

8. The self-propelled elevator system of claim 7, wherein the one or more sensors are configured to monitor at least one of:

a speed of the elevator car;

an acceleration of the elevator car;

a load in the elevator car;

a position of one or more doors of the elevator car; and a position of one or more brakes of the elevator car.

9. The self-propelled elevator system of claim 7, wherein the elevator car further comprises a second transceiver, wherein the second transceiver is configured to operate on a different frequency than the transceiver to provide full duplex communication.

10. The self-propelled elevator system of claim 7, wherein the controller of each of the plurality of drives are configured to communicate with each other via the wired communications system.

11. The self-propelled elevator system of claim 10, further comprising a lane supervisor configured to communicate with the plurality of drives via the wired communications system, wherein the lane supervisor is configured to monitor the position of the elevator car in the hoistway and to provide instructions to the elevator car to move up and down in the hoistway.

12. The self-propelled elevator system of claim 7, wherein an effective range of the transceiver is less than a height of the elevator car.

13. A self-propelled elevator system comprising:

a hoistway including a plurality of drives, wherein each of the plurality of drives includes a stationary portion of a propulsion system and a controller configured to operate the stationary portion of the propulsion system;

an elevator car comprising a processor and a transceiver, wherein the transceiver is configured to communicate with the controllers of one or more of the plurality of drives that are adjacent to the elevator car; and one or more sensors disposed on the elevator car, wherein the processor is configured to receive signals from the one or more sensors, wherein the controllers of one or more of the plurality of drives that are adjacent to the elevator car are configured to control a movement of the elevator car within the hoistway.

14. The self-propelled elevator system of claim 13, wherein the one or more sensors are configured to monitor at least one of:

a speed of the elevator car;

an acceleration of the elevator car;

a load in the elevator car;

a position of one or more doors of the elevator car; and a position of one or more brakes of the elevator car.

15. The self-propelled elevator system of claim 13, wherein the elevator car further comprises a second transceiver, wherein the second transceiver is configured to operate on a different frequency than the transceiver to provide full duplex communication.

16. The self-propelled elevator system of claim 13, wherein the controller of each of the plurality of drives are configured to communicate with each other via a wired communications system.

17. The self-propelled elevator system of claim 16, further comprising a lane supervisor configured to communicate with the plurality of drives via the wired communications system, wherein the lane supervisor is configured to monitor the position of the elevator car in the hoistway and to provide instructions to the elevator car to move up and down in the hoistway.

18. The self-propelled elevator system of claim 13, wherein an effective range of the transceiver is less than a height of the elevator car.

* * * * *